US005568688A

United States Patent [19]

Andrews

[11] Patent Number: 5,568,688

[45] Date of Patent: Oct. 29, 1996

[54] HAIR SHAVING DEVICE WITH CURVED RAZOR BLADE STRIP

[76] Inventor: Edward A. Andrews, 6835 Beach Rd., Troy, Mich. 48098

[21] Appl. No.: 473,473

[22] Filed: Jun. 7, 1995

[51] Int. Cl.[6] ..... B26B 21/56; B26B 21/08

[52] U.S. Cl. ..... 30/29.5; 30/346.59; 30/356

[58] Field of Search ..... 30/29.5, 356, 113.1, 30/346.59, 346.61, 82

[56] References Cited

U.S. PATENT DOCUMENTS

| | | | |
|---|---|---|---|
| 1,229,824 | 6/1917 | Tewelow . | |
| 1,266,868 | 5/1918 | Sheehan | 30/346.59 |
| 1,370,099 | 3/1921 | Dunkley | 30/113.1 |
| 1,517,600 | 12/1924 | Stock | 30/113.1 |
| 1,799,907 | 5/1927 | Kaufmann . | |
| 1,801,889 | 10/1928 | Ventimiglia . | |
| 1,973,631 | 9/1933 | Johnson . | |
| 2,028,022 | 9/1934 | Sieminski . | |
| 2,055,129 | 9/1936 | Hill et al. . | |
| 2,074,020 | 3/1937 | Marholt . | |
| 2,089,486 | 8/1937 | Kuhn . | |
| 2,111,861 | 3/1938 | Knapp . | |
| 2,139,680 | 12/1938 | Heinrich . | |
| 2,191,073 | 2/1940 | Fishbein et al. . | |
| 2,235,326 | 5/1940 | Muros . | |
| 2,275,180 | 3/1942 | Holsclaw . | |
| 2,488,436 | 11/1949 | Santoro, Sr. | 30/346.61 |
| 3,284,894 | 6/1965 | Ryan . | |
| 3,299,507 | 1/1967 | Mistretta . | |
| 3,381,373 | 5/1968 | Brown . | |
| 3,574,936 | 4/1971 | Bullerman . | |
| 3,731,379 | 5/1973 | Williams . | |
| 3,829,966 | 8/1974 | Owens . | |
| 4,162,574 | 7/1979 | Johnston . | |
| 4,735,605 | 4/1988 | Swartz . | |
| 4,980,974 | 1/1991 | Radcliffe | 30/356 |
| 5,012,576 | 5/1991 | Johannesson . | |

FOREIGN PATENT DOCUMENTS

| | | | |
|---|---|---|---|
| 383162 | 6/1922 | Germany | 30/113.1 |

*Primary Examiner*—Kenneth E. Peterson
*Attorney, Agent, or Firm*—Harness, Dickey & Pierce, P.L.C.

[57] ABSTRACT

A manually operated, finger-manipulatable non-electric hair trimming device is provided for shaving nostril hair, ear hair or the like. The hair trimming device includes a head structure sized to fit within a small body cavity, such as a person's nostril or ear cavity, and is arranged to support a flexible razor blade strip. The head structure has a base portion and a curved guard portion extending from the base portion. The curved guard portion has first and second ends which are attached to the base portion. A finger grip portion is provided having an end connected to the base portion of the head structure, for manually manipulating the hair trimming device. The head structure further has a thin, elongated narrow razor blade strip provided with a razor sharp first edge portion. The razor blade strip is bent to extend substantially along the curved guard portion of the head structure such that the sharpened first edge portion defines a curved end cutting edge for trimming hair within a hard to reach portion of a nose or ear cavity. The sharpened first edge portion also defines a pair of substantially straight portions for trimming hair on the generally flat side walls of a nose or ear cavity.

32 Claims, 7 Drawing Sheets

FIG-23A
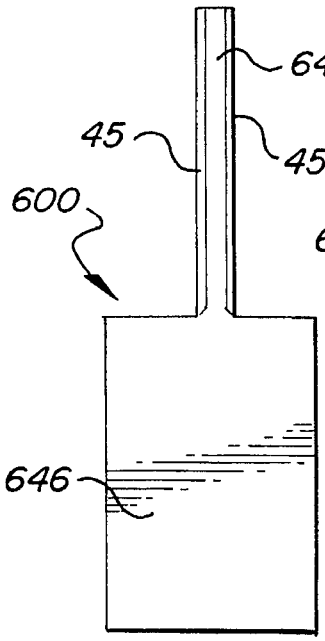
FIG-23B
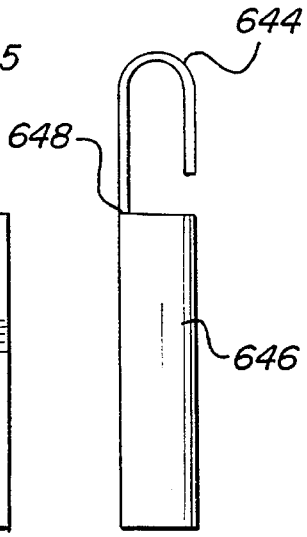
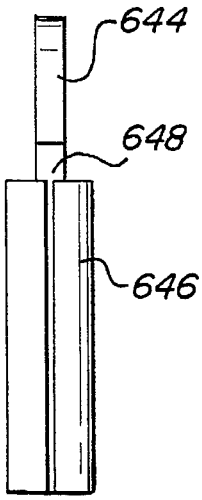
FIG-23C
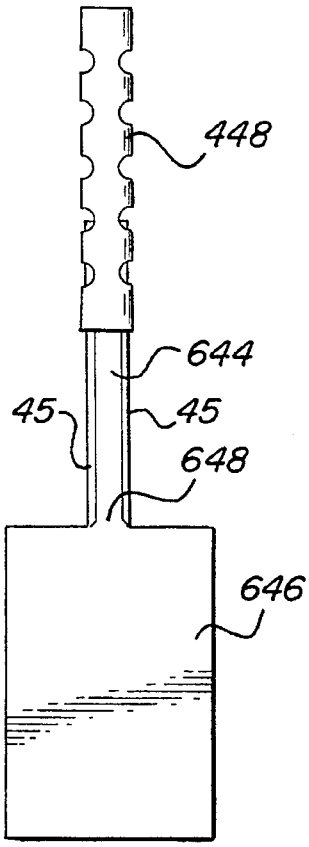
FIG-23D
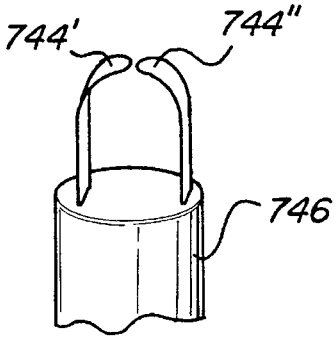
FIG-24
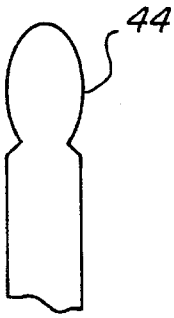
FIG-25
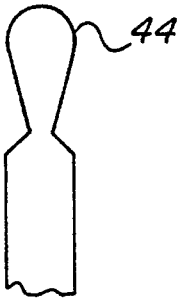
FIG-26
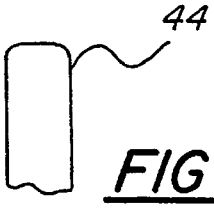
FIG-27

HAIR SHAVING DEVICE WITH CURVED RAZOR BLADE STRIP

FIELD OF THE INVENTION

This invention relates in general to curved razor blade strip structures for shaving hair and to manually-operated nose hair trimming devices, and in particular to small, lightweight manual hair trimming devices having one or more blade strips with curved razor-sharp cutting edge with a blade guard and/or platform adjacent thereto to permit safely and closely trimming hair, with a shaving action, particularly hair within the nostrils or ears.

BACKGROUND OF THE INVENTION

It is a common practice to trim the hair extending out of the nostrils or growing in the ears for aesthetic or health reasons. Many devices are used for this task. The devices range from small manicuring scissors or clippers, to specially made cutting devices or machines specifically designed for the task.

There are known devices for trimming nostril or ear hair which utilize a rotary blade to cut the hair. Examples of such devices are described in the following U.S. Pat. No. 4,162,574 to Johnston, No. 2,191,073 to Fishbein et al., No. 2,074,020 to Marholt, and No. 1,973,631 to Johnson. In these devices, a central rotary blade is disposed within a protective guard. The protective guard is provided with a series of slots for receiving hairs to be cut. The rotary blade is rotated manually to cut the hairs which are received in the slots in the protective guard. Other similar devices include a motor for driving the rotary blade within the protective guard. Examples of this type of motorized device are shown in U.S. Pat. No. 5,012,576 to Johannesson and No. 3,731,379 to Williams. The nostril hair trimming devices which utilize a rotary blade suffer from the disadvantages that the rotary blades are complicated and expensive to manufacture. The blades are not designed to be readily replaceable and sharpening the miniature blades is very difficult. If the blades become dull, proper cutting is not obtained, in which case nostril hairs can be pulled or yanked by the dull rotary blade causing discomfort and irritation to the user. In addition, the rotary blade type hair trimming devices can be unsanitary in that they are very difficult to clean. In such devices, the cut hairs are received and cut within the protective guards and there are no means for easily expelling the hairs from the devices after they have been cut.

Other known devices for trimming hair in the nostril utilize miniature clippers which include a stationary cutter member with a plurality of teeth and an adjacent reciprocating cutter member with a plurality of teeth. Hairs which enter the gaps between the teeth of the stationary cutter member are cut off when the adjacent reciprocating cutter member reciprocates past the stationary cutter member and the hairs are sheared. Examples of these known clipper devices are shown in U.S. Pat. No. 2,275,180 to Holsclaw and No. 2,055,129 to Hill et al. The clipper type hair trimming devices suffer from the disadvantage that the cutter members are expensive to manufacture and are difficult to maintain. In addition, the clippers can present the risk of cuts if the clippers are pressed against the skin of a user, since the skin can be pinched or cut by the reciprocating cutter member. Finally, clipper-type trimmers also can yank and pull the nostril hairs especially when the clipper edges become dull.

There are also known razor-type nostril hair trimming devices. Examples of razor-type hair trimming devices are shown in U.S. Pat. No. 1,229,824 to Tewelow, No. 3,574,936 to Bullerman, No. 2,139,680 to Heinrich, and No. 2,089,486 to Kuhn. The devices disclosed in the aforementioned patents to Tewelow and to Bullerman utilize straight razor blades having a guard along the sharpened edges. The straight razor blades are scraped along the inner wall of the nostril in order to shave off the hair. The razor-type hair trimming devices with a straight blade suffer from the disadvantages that they are believed ineffective in easily cutting hairs from the different curved nostril inner surfaces, from which many hairs extend.

The miniature razor trimming device disclosed in U.S. Pat. No. 2,139,680 to Heinrich utilizes a flat blade having a curved sharpened edge. The blade is angularly mounted on the end of a miniature head. A guard is provided for protecting the user from the sharpened edge of the blade. The miniature razor however suffers from the disadvantage that the blades which require a semicircular sharpened edge are difficult to manufacture.

The nasal razor disclosed in U.S. Pat. No. 2,089,486 to Kuhn uses a very short stiff curved steel razor blade positioned between a pair of hinged supports which are mounted to a handle. This nasal trimming device appears to suffer from the disadvantage that its rigid curved blade is useful only when used in a side scraping fashion. The nasal razor is quite small, and by necessity, the miniature blade is also very small, and therefore appears difficult to manufacture and handle. In addition, the blade is not provided with a long straight edge which is desirable for trimming hairs in certain parts of the nostril.

Thus, there has been a continuing need for some simple, inexpensive, lightweight device for enabling an individual to easily trim the nostril hairs without fear of any accidental cuts or scrapes within the nose. Such a hair trimming device for nostril hair should be capable of safely and effectively trimming hair from both curved and straight surfaces.

Further, there is a need for a nostril hair trimming device which has an easily detached, disposable cutting head or deck, with a substantially permanent reusable handle or finger-grip support structure. There is also a need for a nose hair trimming device that is so small, compact and lightweight that it can fit in a very small size travel toiletry kit or manicuring kit, and can be easily carried around virtually undetected in one's pocket or purse.

The principal object of the present invention is to provide a small, simple-to-operate manual nose hair trimmer with a long curved razor-sharp blade strip which satisfies most if not all of the foregoing needs. An additional object is to also provide such a device which is extremely reliable and safe to use, and which does not require electric power.

A further object is to provide such a nose trimmer with a small grip portion that may be gripped solely in the user's fingertips, for maximum maneuverability. In this way, the user will be able deftly to cut nostril hairs even in the difficult to reach frontal cavity or pocket of each nostril. One more object is to provide an effective cutter head portion which is so small that it can be comfortably inserted into and moved around within a nostril.

One more object is to provide a curved blade hair shaving device which is sufficiently inexpensive so that it may be discarded and replaced frequently. Another object is to provide a nose hair trimming device that does not use a scissors action, and does not have any internal moving parts to break or bind up. One more object is to provide a nostril hair trimming instrument that never pulls or yanks out nostril hairs.

Still another object of the present invention is to provide a cutter portion on a hair shaving device which employs a curved razor blade end-cutting geometry, so that the topmost part of the cutter section of the device can cut hair by a shaving action as well as the side blade strip portion of the cutter section, by using a single sharpened razor blade strip bent into a curved loop configuration.

Another object of the present invention is to use a thin elongated strip of stainless steel provided with a razor-sharp edge that can be mass-produced with ease as the operative tool that is used to shave or cut hair, especially nostril hair. A related important object of the invention is to curve or bend the razor-blade strip into a loop or U-shape to provide the desired end cutting and side-cutting geometry from a single elongated strip of metal alloy having at least one razor sharp edge. A further related object is to provide a cutter head structure that employs a curved elongated razor blade strip within a guard structure that can be easily cleaned to facilitate its reuse.

Yet another object is to provide an easily cleaned curved loop razor blade structure, to facilitate reuse of the curved blade shaving device, which may be a nose hair trimmer, as long as the blade edge remains sufficiently sharp.

Another object is to provide a guarded curved blade shaving device, such as nose hair trimming device, which is inherently easy to operate, so that with a minimum of practice, a user need not even look in a mirror as he uses the device to shave his nostrils or other curved body portions with the device, i.e., those cavities which the end cutting bent loop shape can reach.

Another object of this invention is to provide a razor-sharp nose hair trimmer device which has a manually removable and replaceable, plastic cover which fits over the cutter head for encasing the sharp edge, and is frictionally held in place on the handle, so that it can be stored and transported safely.

SUMMARY OF THE INVENTION

In order to fulfill the most if not all of the needs and objects above-stated, there is provided according to a first few embodiments of the present invention.

A manually operated, finger manipulatable non-electric nose hair trimming device, comprising: a head structure sized to fit within a person's nose cavity and arranged to support a flexible razor blade strip having a base portion and a curved guard portion extending from said base portion, said curved guard portion having first and second ends which are attached to said base portion; and a finger grip portion having an end connected to the base portion of said head structure wherein said head structure includes; a thin, elongated narrow razor blade strip formed from a strip of flexible flat razor blade material and bent in a central section thereof to provide a substantially semi-circular section disposed in between first and second substantially straight sections on either side thereof that terminate respectively at first and second ends, said razor blade strip being arranged to extend substantially along the curved guard portion of the head and having a sharpened first edge disposed between the first and second ends, the first and second ends being attached at spaced locations to said base portion of said razor head.

In accordance with another embodiment of the present invention, a manually operated, non-electric nose hair trimming device, is provided having a finger grip portion and a head structure having a base portion in connection with said finger grip portion. The head structure having a hook-shaped blade having a first and a second end and at least one razor sharp edge disposed between the first and second ends, the hook-shaped blade is attached to the base portion at the first end from which the hook-shaped blade extends generally perpendicularly away from the base portion and curves around and is adjacent to but spaced from the base portion at the second end of the hook-shaped blade.

In accordance with yet another embodiment of the present invention, a hair trimming razor head structure is provided for trimming nose hair or ear hair which includes a very thin elongated razor blade strip with at least one substantially curved razor-sharp edge for shaving hair within a nose or ear cavity, for attachment to a handle of a hair trimming device. The razor head structure includes a base portion with means for connecting the base portion to the handle and a single thin ribbon-like blade strip having two parallel opposed flat surfaces with a first end and a second end and at least one razor sharp edge disposed between the first and second ends. The blade strip is bent to form a curved blade strip that is generally U-shaped and fits within a nose or ear cavity, and which is attached to the base portion at the first end from which the curved blade strip extends away from the base portion and curves around and is attached again to the base portion at the second end of the curved blade strip.

In accordance with still another embodiment of the present invention, a manually operated, finger-manipulatable non-electric hair trimming device is provided for shaving nostril hair, ear hair or the like. The hair trimming device includes a head structure sized to fit within a small body cavity and arranged to support a flexible razor blade strip. The head structure includes a base portion and a curved guard portion extending from the base portion. The curved guard portion has first and second ends which are attached to the base portions. A finger grip portion is provided having an end connected to the base portion of the head structure, for manually manipulating the hair trimming device. The head structure further has a thin, elongated narrow razor blade strip provided with a razor sharp first edge portion, the razor blade strip being bent to extend substantially along the curved guard portion of the head structure such that the sharpened first edge portion defines a curved end cutting edge for trimming hair within a body cavity.

Other objects, features, operating principles, and advantages of the nose hair trimming devices of the present invention will become apparent upon studying the various Figures in the drawings and reading the following detailed description and subjoined claims.

BRIEF DESCRIPTION OF THE DRAWINGS

In the drawings, where the same reference numerals reference like items or features in the different views:

FIGS. 13A through 13E show enlarged views of a series of elongated thin flexible flat metal alloy razor blade strips with one or more razor-sharp edge portions usable in the various embodiments of the present invention wherein:

FIG. 13A is an elongated razor blade strip having a single sharpened edge and a series of centered slots through which the interlock pins of the cage guard extend;

FIG. 13B is a second razor blade strip having end portions which have rectangular apertures to permit preassembly of the blade onto a correspondingly-shaped protrusion of a blade support platform or base structure or a cage guard;

FIG. 13C shows a third razor blade strip having only one side sharpened in three separate places with unsharpened segments therebetween;

FIG. 13D shows a fourth blade strip with a single sharpened edge, to be used in my hair shaving devices to provide end-cutting only; and FIG. 13E is a fourth blade strip having a plurality of notches to permit the blade segments therebetween to be flexed or be twisted.

FIG. 17 is a perspective view of the tenth embodiment with the base portion only partly shown;

FIG. 18 shows a plan view of the sheath before folding overlaid upon a phantom view of the sharpened razor blade;

FIG. 19 shows an end cross-sectional view taken along lines 19—19 of FIG. 17, further showing how the sheath is wrapped around the blade strip; and FIG. 20 is a top cross-sectional view taken along lines 20—20 of FIG. 17, showing two concentric metal rings snapped together which hold the ends of the metal blade and blade edge guard sheath in place.

FIGS. 23A–23D illustrate a twelfth embodiment of the nose hair trimmer of the present invention, including a U-shaped hook blade connected at only one end to the base portion;

FIG. 24 is a perspective view of a thirteenth embodiment of the present invention, which includes a plurality of blade strip portions symmetrically arranged about an oval base support structure; and FIGS. 25–27 show simplified side views of alternative shapes that can be utilized for the bend in the razor blade strips used in the shaving devices of the present invention.

DETAILED DESCRIPTION OF THE PREFERRED EMBODIMENTS

Several different hair trimming devices of the present invention which employ one or more curved razor-sharp blade strips are shown in the Figures and discussed herein. While these embodiments are presently preferred, they are still only exemplary of the various possible curved razor blade strip hair shaving structures and devices of the present invention. As explained further below, I contemplate that, within the scope of the present invention, variants of the curved blade shaving devices of my present invention may readily be constructed based upon my teachings herein.

Figure 1:
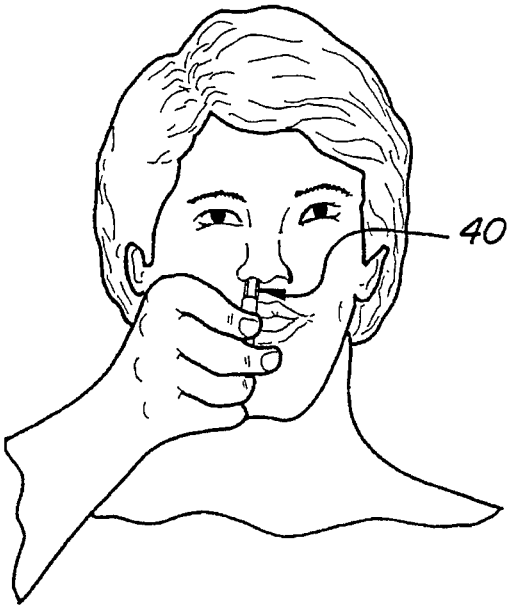
FIGS. 1 and 2 are a front view and an enlarged side perspective view respectively of a man using a first embodiment of the curved blade hair trimming device of the present invention, also shown in FIG. 3, to trim hair within his nose.
Figure 2:
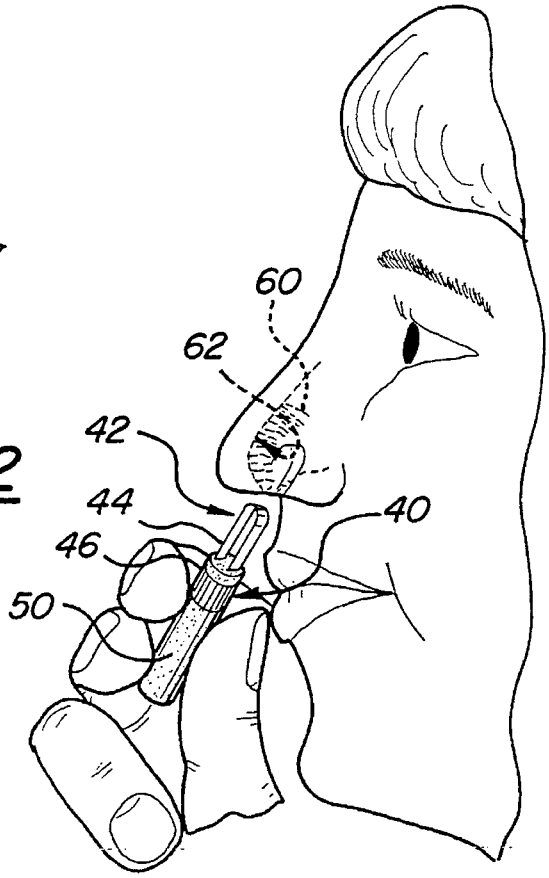

With reference to FIGS. 1 and 2, there are shown a front and a side perspective view of a man using a first embodiment of a basic hair shaving device of the present invention which has a U-shaped razor-sharp blade strip therein, for shaving his nostril hair. In FIG. 1, the nose hair trimming device 40 has a finger-grip sized grip portion, which is hidden by the user's hand. In FIG. 2, a finger-grip sized grip portion 50 can be seen and is connected to a head structure 42 which includes a curved blade 44 connected to a base portion 46. The nose hair trimming device 40 can be used to safely and effectively trim nostril hair 60 from both curved and straight surfaces within the user's nostril by the use of a straight, generally downwardly-directed shaving stroke. In addition, the curved end-cutting geometry allows the device to be used to cut nostril hairs 60 in the difficult to reach frontal cavity or pocket 62.

Figure 3:
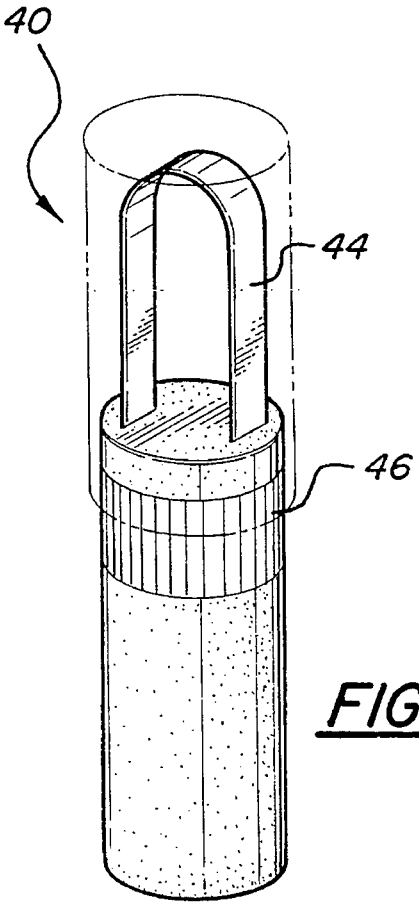
FIG. 3 is a side perspective view of the basic shape of the curved blade razor shaving device of the present invention, with its optional protective guard and with a clear plastic cover shown in phantom showing the inverted U-shape of its metal blade strip, having at least one full razor-sharp edge, embedded into the fingergrip base.

With reference to FIG. 3, a perspective view is shown of a basic trimmer 40 of the present invention without a protective guard. The basic geometry of the hair trimming device 40 includes a U-shaped metal blade strip 44 embedded into a base 46. The blade strip 44 is ribbon-like and is provided with two parallel opposed flat surfaces and a razor sharp edge. A cap member 47 is shown in phantom for covering the blade 46.

Figure 4:
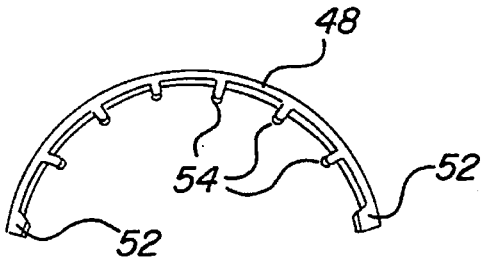
FIG. 4 is a perspective view of a first embodiment of the protective blade guard cage having multiple overhanging guard fingers, that is usable with the FIG. 3 embodiment.

FIG. 4 is a perspective view of a protective blade guard 48 usable with the device of FIG. 3. The protective blade guard 48 is provided with two end portions 52 for connecting the protective blade guard to the metal blade strip 44 or the base portion 46. The protective guard 48 is also provided with a plurality of teeth or fingers 54 which are designed to overhang portions of the sharpened edges on either side of the elongated blade strip 44. Depending upon the width, number and spacing of the fingers 54, anywhere from about 20 percent to about 80 percent of the blade edge may be exposed through the spaces between the fingers 54, with 35 to 70 percent exposure being preferred. The fingers extend sufficiently beyond the sharpened edge of the adjacent blade, by about 0.5 mm to about 2 mm or more, depending upon the finger spacing, so that it is essentially impossible for the skin of the user to make a contact with the sharpened blade edge, even when above average side pressure is applied to by the user to the cutter end of the device. In particular, when the spacing of the fingers 54 is sufficiently close, such as on the order of about 1 mm to about 2 mm, this result is easily accomplished. The width of the individual fingers 54 is preferably on the order of about 1 mm to about 4 mm, with 2 to 3 mm being presently preferred. The outer surfaces of the fingers 54 that do or potentially can come into contact with the user's skin are preferably gently rounded as shown to reduce the possibility of inadvertently scratching the user's skin. Such scratches might otherwise occur with sharp edges on the fingers as a user draws the fingers gently across his skin within his nostrils (or elsewhere) as he executes a generally linear and downwardly directed or laterally directed shaving stroke across the skin from which the nostril hairs to be trimmed protrude.

Figure 5:
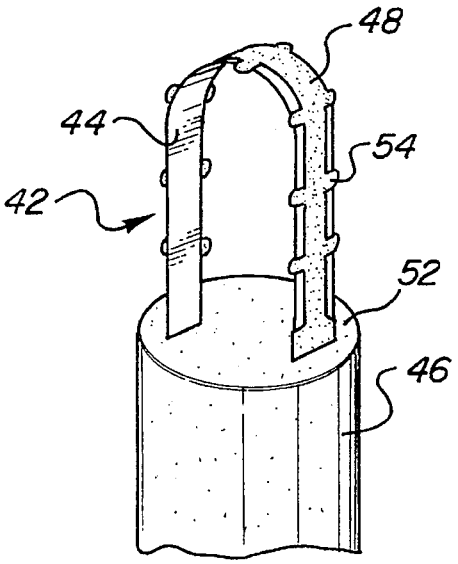
FIG. 5 is a perspective view of a second embodiment, of the curved blade hair shaving device of the present invention, showing the FIG. 4 protective blade guard in place over the metal blade strip of the FIG. 3 device, and revealing how the fingers partially envelop the edge of the blade strip.

FIG. 5 is a perspective view showing a second embodiment of the present invention with the protective blade guard 48 in place over the metal blade strip 44 of the device shown in FIG. 3. The protective guard 48 can be secured to the metal blade strip 44 by any means including glue.

Figure 6A:
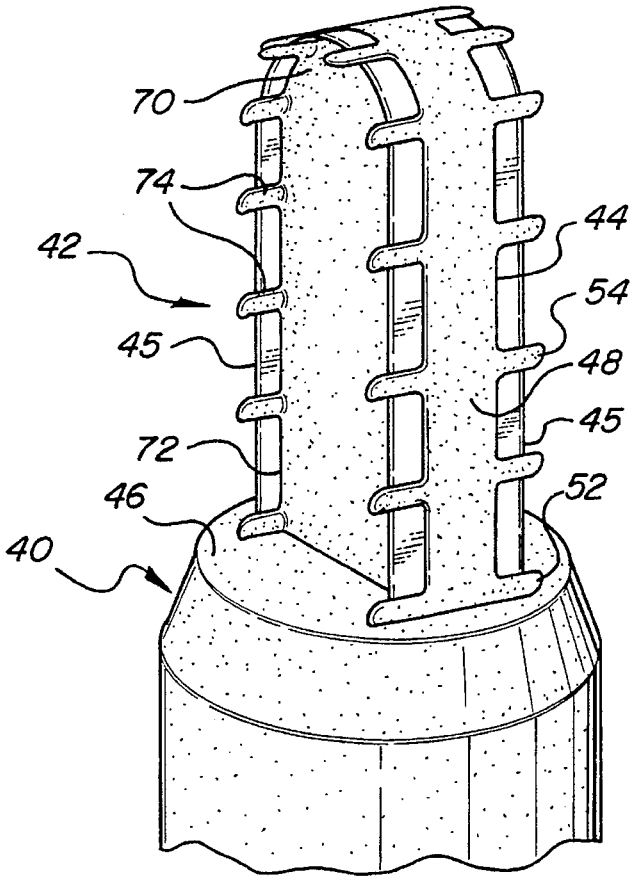
FIG. 6A is a perspective view of a cutter end portion of a third embodiment of the curved blade hair shaving device of the present invention, showing an elongated double-edged razor blade strip, an (inverted) U-shaped solid blade support platform inside the blade strip, and a multiple finger guard cage interlocked by pins (not shown), the blade strip extending through and into the support platform overlaying the sharpened blade edges for protecting the user's skin against blade nicks.

FIG. 6A is a perspective view of a third embodiment of the head structure 42 of the nose hair trimming device 40 of the present invention. In FIG. 6A there is shown a horseshoe-shaped blade support platform 70 which is attached to a base portion 46 of the head structure 42. A double-edged blade strip 44 is wrapped around the horseshoe-shaped blade support platform 70 such that each of the sharpened edges 45 of the double-edged blade strip 44 extend beyond outer edges of a blade seat portion 72 of the horseshoe-shaped blade support platform 70. A multiple finger guard cage 48 overlays the blade edges 45 for protecting against blade nicks. The multiple finger guard cage 48 secures the blade in its position along the blade seat portion 72 by means which will be described in greater detail hereinafter. The blade seat portion 72 of the blade support platform 70 is provided with a plurality of extending fingers 74 which correspond with the fingers 54 of the cage guard 48.

Figure 6B:
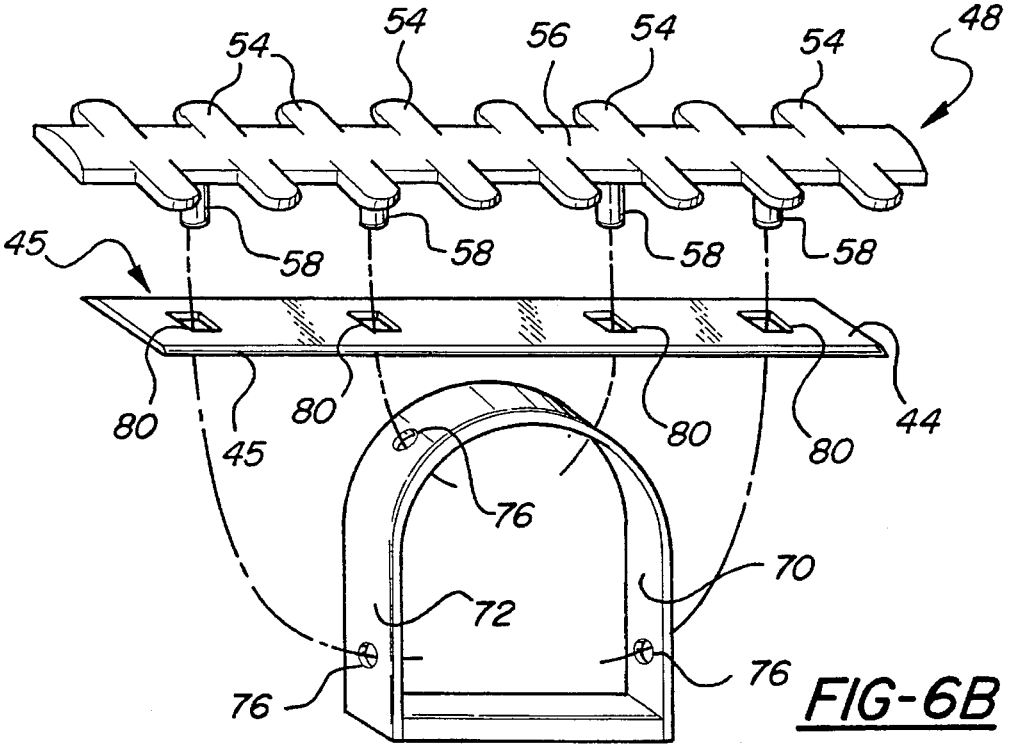
FIG. 6B is an exploded perspective view of the components of the cutter end portion of the fourth embodiment which is like the third embodiment of FIG. 6A, except the blade support platform (which is a hollow second version) of a nose hair trimming device of the present invention.

FIG. 6B is a perspective view of a fourth embodiment of the present invention illustrating the assembly of the head structure 42 of the nose hair trimming device 40. In particular, a horseshoe-shaped blade support platform 70 is provided having a plurality of pin receiving holes 76 disposed in the periphery of the horseshoe-shaped blade support platform 70. A double-edged blade strip 44 is shown having a plurality of pin receiving holes 80 which correspond to the locations of the pin receiving holes 76 of the horseshoe-shaped blade support platform 70. The double-edged blade strip 44 is wrapped around the periphery of the blade seat portion 72 of the blade support platform 70. A multiple finger guard cage 48 is provided having an elongated central portion 56 with a plurality of protective fingers 54 extending laterally therefrom. In addition, a plurality of pins 58 extend from a bottom of the elongated central portion 56 thereof. In order to assemble the head structure 42 of the nose hair trimming device 40, the pins 58 of the multiple finger guard cage 48 are inserted through the pin receiving holes 80 in the double-edged blade strip 44 and both the multiple finger guard cage 48 and the double-edged blade strip 44 are wrapped around the periphery of the blade seat portion 72 of the blade support platform 70. The pins 58 are then inserted into the holes 76 provided in the periphery of the blade seat 72 in order to secure the blade strip 44 and the guard cage 48 to the blade support platform 70.

Figure 7A:
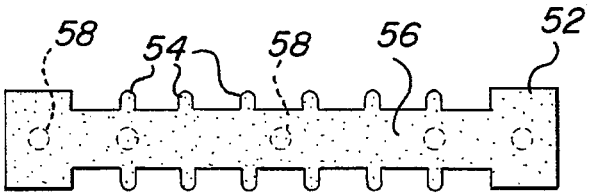
FIGS. 7A and 7B are top and side elevational views, respectively, of an alternate version of the guard cage usable within the two versions of the embodiments shown in FIGS. 6A and 6B, which guard cage has overhanging fingers that will partially envelop the edges of the blade strip.
Figure 7B:
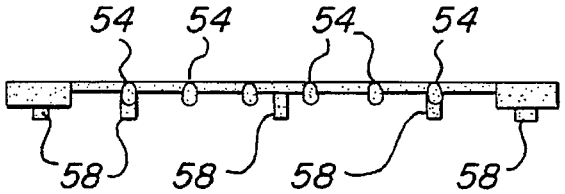

With reference to FIGS. 7A and 7B, the multiple finger guard cage 48 used in the fourth embodiment will be described in detail. The multiple finger guard cage 48 includes a central elongated strip 58 having two end connecting portions 52. A plurality of laterally extending fingers 54 extend from the first and second edges of the elongated central portion 56. As best seen in FIG. 7B, the lateral extending fingers 54 extend beyond a lower surface of the elongated central portion 58. A plurality of pins 58 are also provided which extend from the lower surface of the end connecting portions 52 and at intervals along the elongated central portion 58. The number of pins 58 can be varied according to specific design choices.

Figure 8:
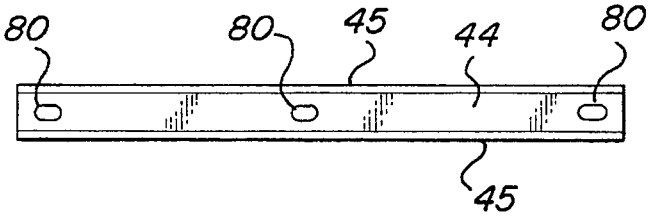
FIG. 8 is a plan view of a representative elongated thin blade strip for the fourth embodiment (FIG. 6) shown laid out in planar form, which reveals the opposed razor-sharp blade edges and a series of apertures through which the locking pins of the guard cage protrude.

With respect to FIG. 8, a double-edged 45 blade strip 44 according to the fourth embodiment is shown in planar form. The blade strip 44 is provided with two sharpened edges 45 and a plurality of elongated apertures 80 through which pins of the guard cage are inserted.

Figure 9:
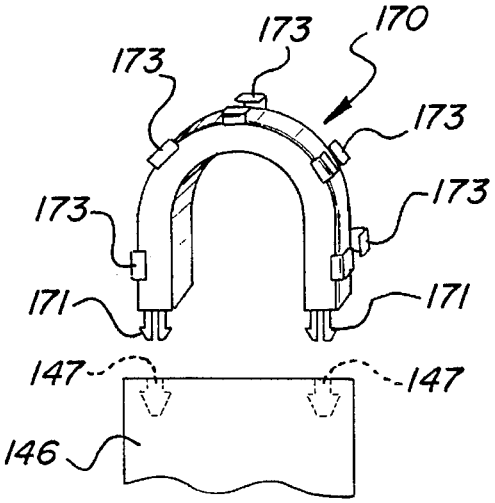
FIG. 9 is a side perspective view of a fifth embodiment of the present invention, which employs a third version of a U-shaped blade support platform, which has protruding side ears that are used in place of the guard cage shown in the second embodiment, and which also has nape-prongs at the lower free ends of the support platform that couple into corresponding apertures in the base portion.

FIG. 9 is a side view of a fifth embodiment of the nose hair trimmer of the present invention which employs a horseshoe-shaped blade support platform 170. The blade support platform 170 is provided with nape-prongs 171 at the lower ends of the blade support platform 170 which couple into corresponding apertures 147 in the base portion 146. The blade support platform 170 is provided with protruding side ears 173 which take the place of the guard cage shown in the fourth embodiment. The protruding side ears 173 extend beyond the outer edges of a blade strip, not shown, and wrap around the outer edges of the blade strip in order to secure the blade strip to the blade support platform 170. As noted above, the protruding side ears 173 provide a guard for protecting against blade nicks.

Figure 10:
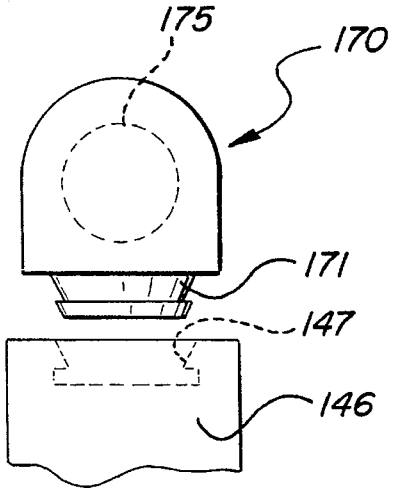
FIG. 10 is a side elevational view of a sixth embodiment of the present invention, which employs a fourth version of a U-shaped blade support platform with an oblong lower post with lower protruding lip that snaps into a single corresponding internal hole with lower internal groove in the fingertip base.

With respect to FIG. 10, a sixth embodiment of the present invention is shown with a second version of the blade support platform 170 having a single prong 171 for insertion into a corresponding internal hole 147 of the fingergrip base 146 is shown. The blade support platform 170 may be provided with a centrally disposed hole 175 as shown in phantom lines.

Figure 11:
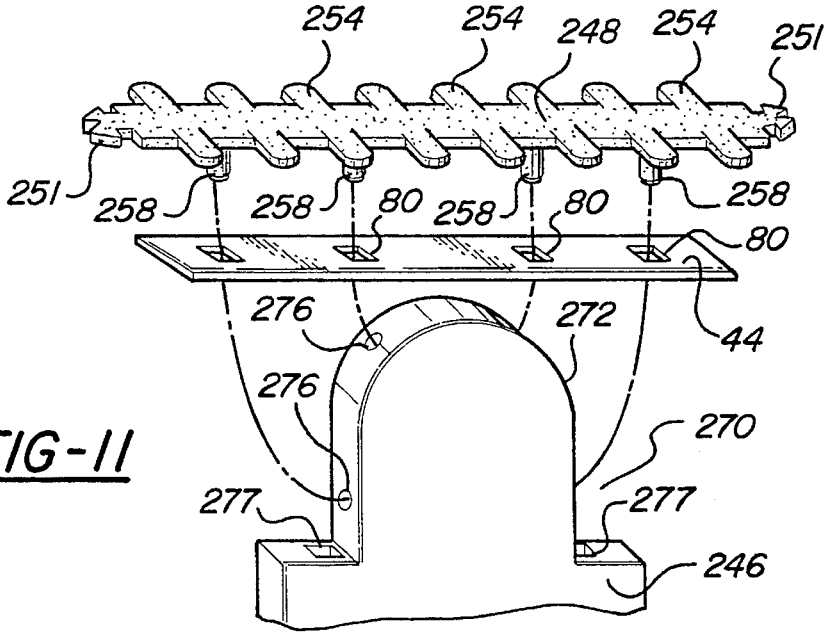
FIG. 11 is a side elevational view of a seventh embodiment, which employs a fifth version of my U-shaped blade support platform made from plastic material with an integral fingergrip base, showing the curved blade strip and cage guard ready to snap into registration holes in the integral platform and base.

As shown in FIG. 11, a seventh embodiment of the present invention is shown with a third version of a blade support platform 270. The blade support platform 270 is provided with a base portion 246 and a U-shaped blade seat portion 272 integrally formed. The U-shaped blade seat portion 272 is provided with a plurality of holes 276 at various intervals around the periphery of the blade seat portion 272. A pair of receiving holes 277 are also provided in the base portion 246 adjacent to each side of the blade seat portion 272. A blade strip 44 and a multiple finger guard cage 248 are provided for being assembled onto the blade support platform 270. The guard cage 248 is provided with a plurality of pins 258 which are inserted in corresponding pin holes 80 in the blade strip 44 and also inserted into the pin holes 276 of the blade support platform 270. The multiple finger blade guard 248 is also provided with nape-prongs 251 on each end thereof which are inserted into the holes 277 in the base portion 246 of the blade support platform 270.

Figure 12:
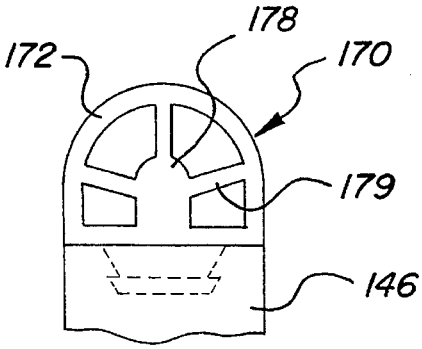
FIG. 12 shows an eighth embodiment having a sixth version of my U-shaped blade support platform which is substantially open and has supporting ribs connected to a central post.

With respect to FIG. 12, a eighth embodiment of the present invention with fourth version of the blade support platform 170 is shown. The blade support platform 170 is provided with a blade seat portion 172 and a centrally disposed portion 178. A plurality of supporting ribs 179 extend from the centrally disposed portion 178 to the blade seat portion 172.

Figure 13A:
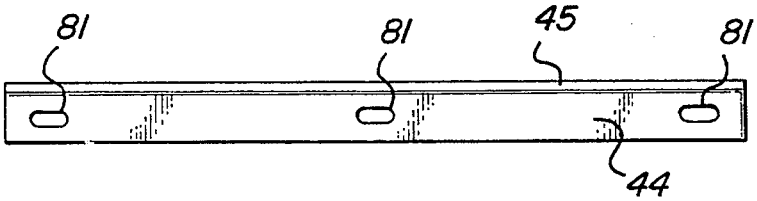

FIGS. 13A–13E show a series of razor-blade strips usable in the various embodiments of the present invention. FIG. 13A shows an elongated razor blade strip 44 having a single sharpened edge 45. The razor blade strip 44 is provided with a series of centered slots 81 through which pins of the blade guard extend.

Figure 13B:
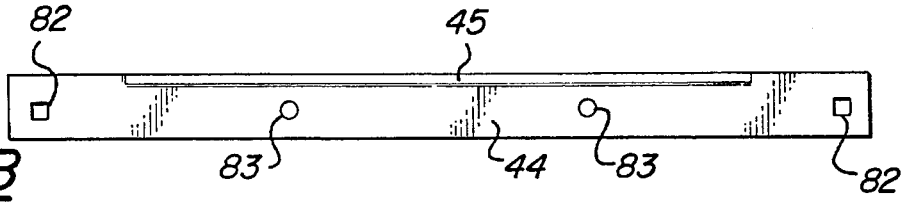

FIG. 13B is a similar razor blade strip 44 having a single sharpened edge 45 which extends only partially along the length of the blade strip 44. A pair of rectangular apertures 82 are provided in each end of the blade strip and a pair of centrally disposed pin holes 83 are provided to permit preassembly of the blade onto a base structure.

Figure 13C:
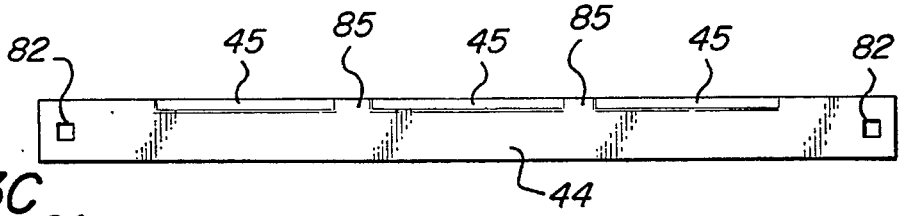

FIG. 13C shows a third razor blade strip having three sharpened edges 45 in separate places along one side with unsharpened segments 85 therebetween. The unsharpened segments 85 are designed to correspond to the location of the fingers 54 of the guard cage 48. In this way, the fingers 54 of the cage 48 will not be cut by the sharpened edges 45 of the blade strip 44.

Figure 13D:
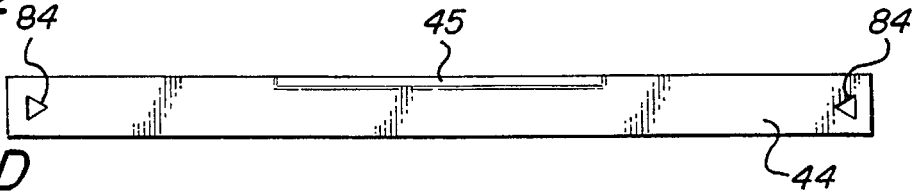

FIG. 13D shows an elongated blade strip 44 with a single sharpened edge 45 which is provided in the central portion of the blade strip 44. The location of the sharpened edge 45 in the central portion provides a nose hair trimming device with end-cutting capability only. A pair of triangular apertures 84 are provided in the ends of the blade strip 44.

Figure 13E:
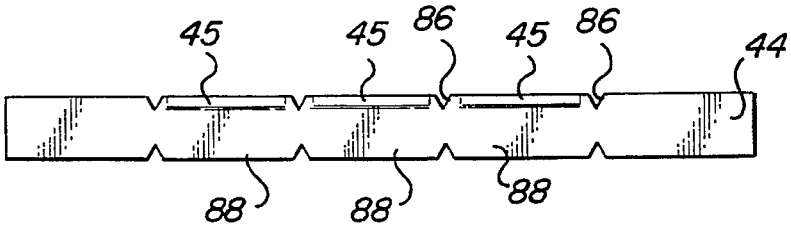

FIG. 13E is an elongated razor blade strip 44 having a plurality of notches 86 to permit the blade segments 88 to flex or be twisted. Twisting of the blade segments 88 may be desirable in order to angle the sharpened edge 45 of the blade in order to improve the cutting angle. It is anticipated that the blade seat portion of the blade support platform would also have to be angled in order to support the notched blade segments 88 in the twisted or angled position.

Figure 14A:
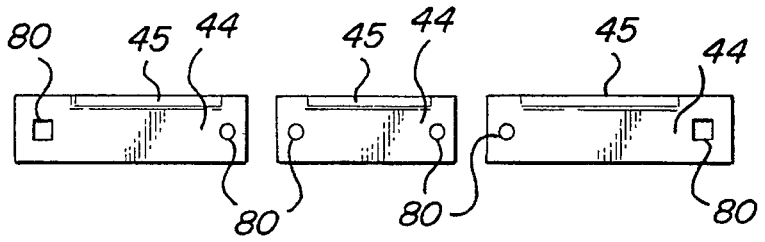
FIG. 14A shows a long segmented razor blade strip structure laid flat consisting of three separate elongated thin flexible blade strips, each having a long razor sharp edge portion and a plurality of pin locating apertures.

FIG. 14A shows a segmented razor blade structure consisting of three separate blade strips 44. Each separate blade strip has a sharpened edge portion 45 and a pair of pin locating apertures 80.

Figure 14B:
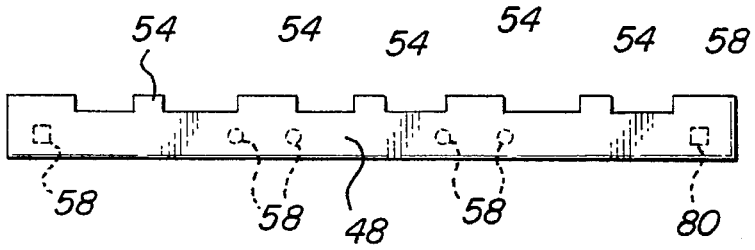
FIGS. 14B and 14C are top and side views of a single-sided semi-flexible cage guard structure shown laid flat, which is designed for use with the FIG. 14A segmented razor blade strip structure, with the FIG. 14C view being taken along lines 14C—14C of FIG. 14B and showing the seven overhanging finger segments and the six interlocking pins of the cage guard structure.
Figure 14C:
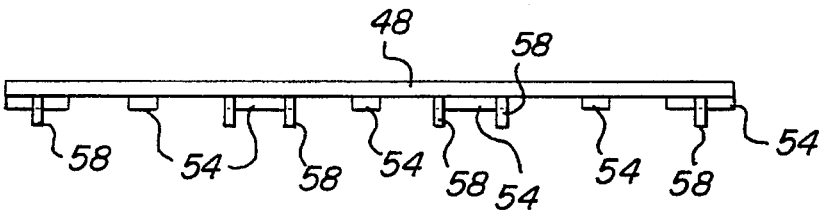

FIG. 14B is a top view of a single-sided guard structure 48. The guard structure includes a plurality of finger segments 54, some of which correspond to the engagement locations of the separate blade strips 44 shown in FIG. 14A. A plurality of pins 58 are best shown in FIG. 14C the bottom surface of the guard structure 48. The pins 58 are inserted into the pin locating apertures 80 of the separate blade strips 44 in order to mount the blades to the blade support platform.

Figure 15:
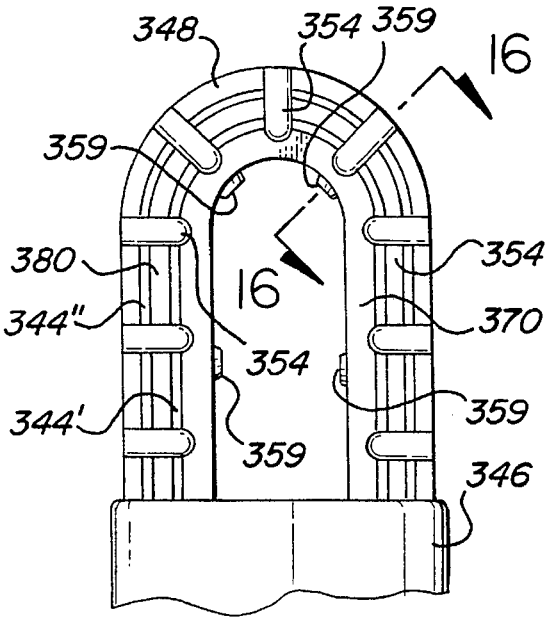
FIG. 15 is a side elevational view of the cutter end portion of a ninth embodiment of the curved blade hair shaving device of the present invention which had two elongated razor blade strips arranged in an evenly spaced relation to one another about a U-shaped blade deck support structure.
Figure 16:
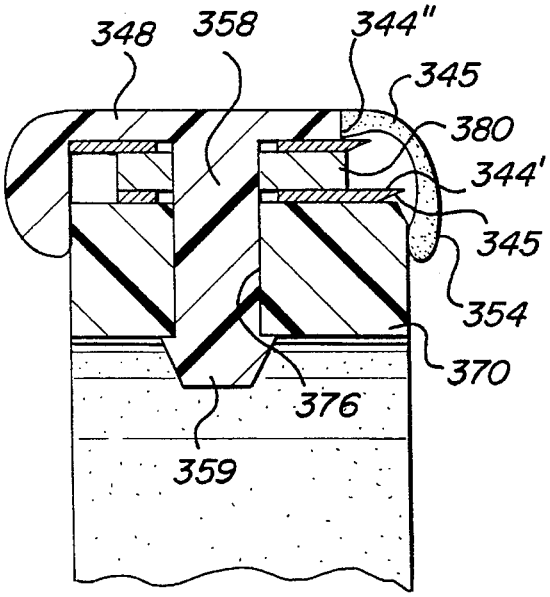
FIG. 16 is an enlarged cross-sectional view, taken along line 16—16 of FIG. 15, showing the spaced arrangement of the two blade strips and an interlocking pin of the cage guard structure passing through the blade strips and blade deck.
Figure 17:
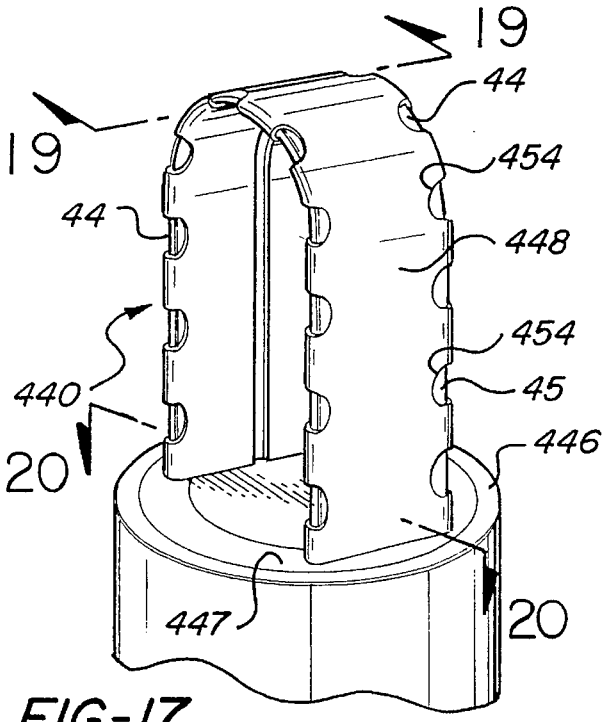
FIGS. 17 through 20 show a tenth embodiment of the nose hair trimmer of the present invention which has a substantially rigid to semi-flexible stainless steel blade strip having two razor sharp edges surrounded by a thin folded metal sheath having a plurality of apertures therein to expose the portions of the sharpened blade edges, where.

With respect to FIG. 15, a side view of the cutter end portion of a nose hair trimmer 340 according to a ninth embodiment of the present invention is shown having two blade strips 344', 344". FIG. 16 shows a cross-sectional view taken along lines XVI13 XVI of FIG. 15 illustrating the double blades 344', 344". In FIGS. 15 and 16, a blade support platform is provided. The blade support platform 370 is provided with a plurality of apertures 376 disposed therein. A first blade strip 344' is wrapped around the outer periphery of the blade support platform 370. A spacer member 380 is then wrapped around the first blade 344' and a second blade 344" is then wrapped around the spacer member 380. The first and second blades 344', 344' and the spacer member 380 are each provided with apertures, not numbered, which receive a pin 358 which extends from a guard cage 348 which is wrapped around the double blade structure. The guard cage 348 is provided with a plurality of fingers 354 which protect a user's skin from contacting the sharpened edges 345 of the first and second blade strips 344', 344". The pins 358 which are provided on the guard cage 348 have a head portion 359 which is extended through the apertures in the first and second blade members 344', 344", the spacer member 380 and the blade support platform 370 in order to secure the blade guard cage 348 in place.

Figure 18:
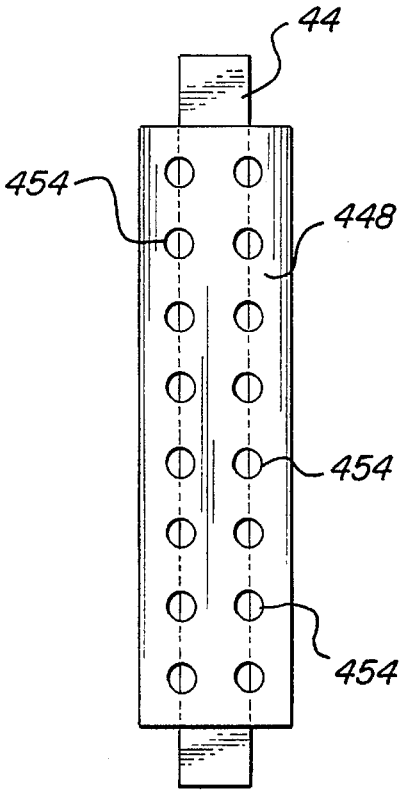
Figure 19:
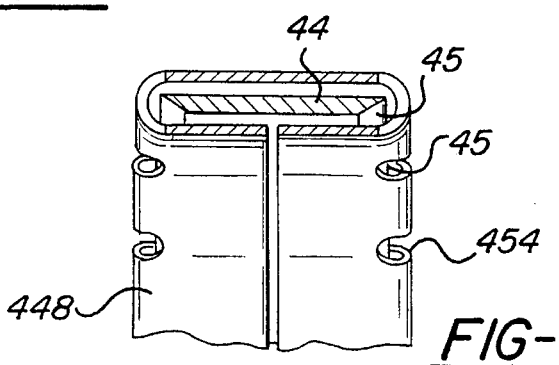
Figure 20:
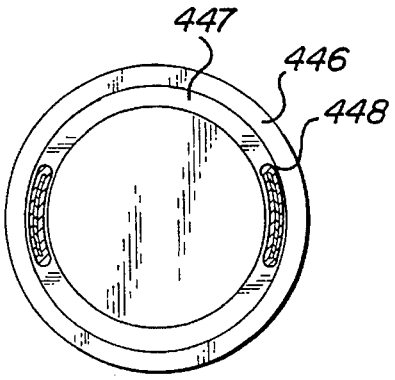

FIGS. 17–20 show a tenth embodiment of the nose hair trimmer 440 of the present invention. According to this embodiment, a double-edged blade strip 44 is provided within a stainless steel blade housing 448. The stainless steel blade housing 448 is provided with a plurality of apertures 454 which expose the blade edge 45. The stainless steel blade housing 448 is formed by providing a flat strip 448 with a plurality of apertures 454, as shown in FIG. 18. The flat strip 448 is then wrapped around the blade strip 44 as shown in cross-section in FIG. 19. The blade housing 448 may be secured to the base portion by any means. FIG. 20 shows two concentric metal rings 446, 447 snapped together which hold the metal blade 44 and blade housing 448 in place. The blade housing 448 is welded to the ring 447 or held in place by other known means.

Figure 21:
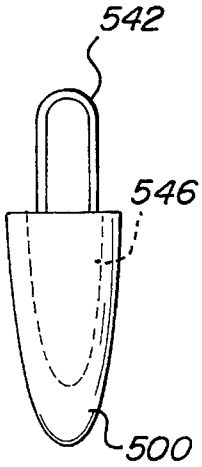
FIG. 21 shows an eleventh embodiment of the present invention, which includes a fingergrip-sized base connected to the nose hair trimming end portion, with a plastic cap disposed over the base and ready to be placed over a cutter end when not in use.
Figure 22:
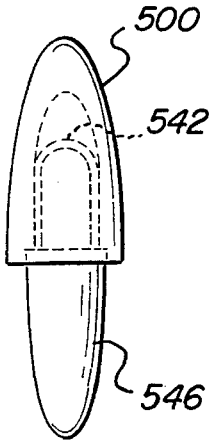
FIG. 22 shows the FIG. 21 device with cap in place covering the cutter end.

With respect to FIG. 21, a eleventh embodiment of the present invention is shown which includes a fingertip-sized base 546 connected to the nose hair trimming head structure 542. A plastic cap 500 is also provided which can be inserted on either end of the fingertip-sized base 546. When the plastic cap 500 is placed over the fingertip-sized base 546 as shown in FIG. 21, the plastic cap 500 can also be used as a handle portion. The U-shaped nose hair trimming head structure 542 can be any of the above-described types. In FIGS. 21 and 22, the U-shaped nose hair trimming portion is merely drawn schematically. With the plastic cap 500 covering the head structure 542, as shown in FIG. 22, the device can be easily carried in a user's pocket, purse or cosmetic case.

With respect to FIGS. 23A–23D, a twelfth embodiment of the nose hair trimmer of the present invention is shown. In FIG. 23A, a flat piece of metal 600 is shown having a base portion 646 and an elongated strip 644 having two sharpened edges 45. The base portion 646 is rolled in order to form a handle portion as shown in FIGS. 23B and 23C. The blade portion 644 is then bent to form a U-shaped hook blade connected at only one end 648 to the base portion. In FIG. 23D, a stainless steel blade housing 448 is shown being slid over the blade portion 644. The stainless steel blade housing 448 is similar to that disclosed in FIGS. 17–19. It is also noted that as an alternative to the embodiment shown in FIGS. 23A–23D, the blade housing may be integrally formed with the base portion of a single sheet of metal instead of the blade member. In this way, a separate blade strip can then be inserted into the blade housing which is integrally formed with the base portion. In either embodiment, the blade strip and the blade housing can be welded, soldered, glued, or held to one another by any other known means.

With respect of FIG. 24, an alternative blade construction is schematically shown wherein the cutting blade includes two separate blades 744', 744' each embedded in an oval cross-section base support structure 746. Each blade strip 744', 744' is curved toward one another at their end portions to form a substantially U-shaped cutting surface with an opening therebetween. A guard structure of any of the types disclosed above can be used in conjunction with this blade structure.

With respect to FIGS. 25–27, alternative shapes for the curvature of the blade strip are shown. One of ordinary skill would of course recognize that the blade can be bent in many shapes without departing from the scope of the present invention.

My razor-sharp nose hair trimming device can be implemented as a structure that is symmetrical or asymmetrical about an imaginary central longitudinal axis which divides the forward blade-supporting portion and fingergrip portion from one another. Unless otherwise indicated, they are also symmetrical about the central plane of the overall device, in which the central longitudinal axis is found. Thus, those in the art should appreciate that the descriptions herein of one side, end, or section of any given cutting head or handle will also serve to describe the other half of said symmetrical structure on the opposite side of the central imaginary axis or central longitudinal plane.

The finger-grip portion 50 of the nose hair trimming device may be made of a molded plastic material or of a metal stamping or casting. The body of the device is divided into a head portion 42 and an integral finger grip portion 50. The overall length of the device is relatively small, as for example, on the order of 1.5 to 3.5 inches long with the cutter end or head section being roughly ¾ inches long. In addition, the fingertip grip portion is preferably axially aligned with the head.

A small overall size of the device permits fingertip holding, which results in better control of the cutting action. This enables the user to cut with a light touch as he (or she) trims the body hair in the cavity. Precise or detailed control and positioning is further facilitated by the light weight of the device.

With the cover, which can be cap-like or sleeve-like, which cover can be used with any of the described devices, a convenient nose hair trimming system is provided which is sanitary, safe, easily usable and sufficiently inexpensive that it may be discarded after a limited number of uses.

Further, although the foregoing embodiments are discussed with respect to the nostril hair trimming, those skilled in the art will appreciate that these same devices may also be used for trimming hair within ears of humans or animals (such as certain breeds of dogs that have hair growing within their outer ears) or other parts of a person's or an animal's body where small depressions or cavities are present where hair to be trimmed is present. Also, those in the art will appreciate that barbers, health care professionals, geriatric attendants and other care-givers may safely use the trimmers of the present invention to cut the nostril and/or ear hair of their customers and/or patients.

Those skilled in the field will appreciate that the foregoing illustrated and discussed embodiments of the shaving devices of the present invention are subject to modification and change without departing from the scope of the invention as recited in the claims below. Needless to say, the overall size, proportion, materials, weight and clearances of the various components used in the razor-holding portions, finger-grip sized portions, and connection mechanisms for attaching the blade strip to the body of the shaving devices of the present invention can be varied as needed or desired. A number of other possible modifications have already been described above. Further changes are clearly possible, as different features and aspects of one embodiment may be combined with another embodiment to provide a nose hair trimming device with the desired features from both.

Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

I claim:

1. A manually operated, finger-manipulatable non-electric nose hair trimming device, comprising:

a head structure sized to fit within a person's nose cavity and arranged to support a flexible razor blade strip having a base portion and a curved guard portion extending from said base portion, said curved guard portion having first and second ends which are attached to said base portion; and a finger grip portion having an end connected to the base portion of said head structure;

wherein said head structure includes a thin, elongated narrow razor blade strip formed from a strip of flexible flat razor blade material and bent in a central section thereof to provide a substantially semi-circular curved section disposed in between first and second substantially straight sections on either side thereof that terminate respectively at first and second ends, said razor blade strip being arranged to extend substantially along the curved guard portion of the head structure and having a sharpened first edge disposed between the first and second ends, the first and second ends being attached at spaced locations to said base portion of said razor head.

2. The nose hair trimming device as in claim 1, wherein the curved guard portion of said head structure is an assembled structure including:

a blade seat structure with blade strip locating means for restricting the razor blade strip to a predetermined location; and a blade cap structure for helping captivate the razor blade strip to the predetermined location.

3. The nose hair trimming device as in claim 2, wherein said blade seat structure is connected with said head structure base portion and said blade cap portion is provided with securing means for securing the blade cap structure relative to said blade seat structure.

4. The nose hair trimming device as in claim 3, wherein said blade seat structure is provided with support means for supporting said blade seat, said blade seat having an edge portion located near but spaced apart from said sharpened first edge of said razor blade strip.

5. The nose hair trimming device as in claim 3, wherein said blade cap structure is provided with a series of spaced teeth which extend beyond the sharpened first edge of said razor blade, and said blade seat structure is provided with an edge portion which is located near but spaced apart from said sharpened first edge of said razor blade strip.

6. The nose hair trimming device as in claim 2, wherein said blade seat structure is provided with a series of spaced teeth which extend beyond the sharpened first edge of said razor blade strip, and said blade cap structure is provided with an edge portion which is located near but spaced apart from said sharpened first edge of said razor blade strip.

7. The nose hair trimming device as in claim 1, wherein said curved guard portion and said blade strip are substantially U-shaped.

8. The nose hair trimming device as in claim 1, further comprising a protective cap which is snapped on over the head structure when the nose hair trimming device is not in use.

9. The nose hair trimming device as in claim 1, wherein said razor blade strip includes a plurality of separate razor blade segments which are connected in series.

10. The nose hair trimming device as in claim 1, wherein said razor blade strip is provided with a plurality of notches and said curved guard portion is provided with a plurality of teeth which extend beyond said razor blade strip at locations corresponding to said plurality of notches.

11. The nose hair trimming device as in claim 10, wherein said curved guard portion is partially twisted so as to support said razor blade strip in a partially twisted position.

12. The nose hair trimming device as in claim 1, wherein said razor blade strip is provided with a sharpened second edge that is located on a side of the blade strip opposite the first sharpened edge.

13. The nose hair trimming device as in claim 12, wherein the curved guard portion of said head structure includes:

a blade seat structure with blade strip locating means for restricting the razor blade strip to a predetermined location; and a blade retaining means for helping captivate the blade strip to the predetermined location.

14. The nose hair trimming device as in claim 13, wherein said blade seat structure is provided with first and second sets of spaced teeth which respectively extend beyond the sharpened first edge and the sharpened second edge of said razor blade strip.

15. The nose hair trimming device as in claim 1, wherein said head structure and razor blade strip are constructed as a unit such that the razor blade strip is not normally removed from the head structure once installed therein, and wherein the head structure and razor blade strip installed therein are detachable as a unit from said elongated hand grip, whereby a duplicate head structure and a fresh razor blade strip may be installed on the hand grip upon removal of the original unit.

16. A manually operated, non-electric nose hair trimming device, comprising:

a finger grip portion;

a head structure having a base portion in connection with said finger grip portion and having a hook-shaped blade having a first and e second end and at least one razor sharp edge disposed between said first and second ends, said hook-shaped blade is attached to said base portion at said first end from which said hook-shaped blade extends generally perpendicularly away from said base portion and curves around and is adjacent to but spaced from said base portion at said second end of said hook-shaped blade; and further comprising a blade guard adjacent to said hook-shaped blade and including a plurality of teeth which protrude beyond said at least one sharpened edge of said hook-sharpened blade.

17. The nose hair trimming device as in claim 16, wherein said blade guard includes a blade seat structure for supporting said hook-shaped blade in a predetermined position and a blade cap structure for helping to captivate said hook-shaped blade in said predetermined position.

18. The nose hair trimming device as in claim 16, wherein said base portion is made of plastic resin and is detachable from said finger grip portion.

19. A hair trimming razor head structure for trimming nose hair or ear hair which includes a very thin elongated razor blade strip with at least one substantially curved razor-sharp edge for shaving hair within a nose or ear cavity, for attachment to a handle of a hair trimming device, the razor head structure comprising:

a base portion having means for connecting said base portion to said handle, a single thin ribbon-like blade strip having two parallel opposed flat surfaces with a first end and a second end and at least one razor sharp edge disposed between said first and second ends, sid blade strip being bent to form a curved blade strip that is generally U-shaped and fits within a nose or ear cavity, and which is attached to said base portion at said first end from which said curved blade strip extends away from said base portion and curves around and is attached again to said base portion at said second end of said curved blade strip; and a blade guard adjacent to said curved blade strip and including a plurality of portions which extend beyond the razor sharp edge.

20. The nose hair trimming head as in claim 19, wherein said curved blade strip includes a plurality of blade segments which are attached in series.

21. The hair trimming head structure as in claim 19, wherein the blade strip has first and second substantially straight side sections located adjacent the first and second ends and a substantially arcuate section located therebetween, the arcuate section having a first edge with at least a segment thereof which is sharpened and forms said one razor sharp edge.

22. The hair trimming head structure as in claim 21, wherein the first and second side sections extend from their respective ends away from the base portion, and are substantially parallel to one another, wherein plurality of portions of said blade guard include a plurality of teeth which protrude beyond said one razor sharp edge of said curved blade strip, said teeth being disposed closely to the razor sharp edge, the individual teeth projecting outwardly therefrom while being arranged sufficiently closely to one another to prevent a user of the hair trimming head structure from accidentally cutting skin within the cavity by pressing the sharpened edge against skin within the cavity and sufficiently far apart from one another to permit the hairs within the cavity to fit between adjacent teeth, whereby the hairs can be cut with the razor-sharp edge of the blade strip when the razor-sharp edge is moved past the hairs slipping in between the teeth.

23. The nose hair trimming head as in claim 22, wherein said curved blade strip is provided with a plurality of notches and said plurality of teeth of said blade guard are at locations corresponding to said notches in said curved blade.

24. The hair trimming head structure as in claim 23, wherein:

said blade guard includes a blade seat structure for supporting said curved blade strip in a predetermined position; a blade cap structure for helping to captivate said curved blade strip in said predetermined position, and said arcuate section of said blade strip has a substantially semi-circular portion connecting said first and second substantially straight side sections.

25. The nose hair trimming head as in claim 24, wherein said blade seat structure is integral with said base portion and said blade cap structure is provided with securing means for securing the blade cap structure relative to said blade seat structure.

26. A manually operated, finger-manipulatable non-electric hair trimming device for shaving nostril hair, ear hair or the like, comprising:

a head structure sized to fit within a small body cavity and arranged to support a flexible razor blade strip, said head structure having a base portion and a curved guard portion extending from said base portion, said curved guard portion having first and second ends which are attached to said base portion; and a finger grip portion having an end connected to the base portion of said head structure, for manually manipulating the hair trimming device, the head structure further having a thin, elongated narrow razor blade strip provided with a razor sharp first edge portion, said razor blade strip being bent to extend substantially along the curved guard portion of the head structure such that said sharpened first edge portion defines a curved end cutting edge for trimming hair within a body cavity.

27. The hair trimming device as in claim 26, wherein the curved guard portion of said head structure is an assembled structure including:

a blade seat structure with blade strip locating means for restricting the razor blade strip to a predetermined location; and a blade cap structure for helping captivate the razor blade strip to the predetermined location.

28. The hair trimming device as in claim 27, wherein said blade seat structure is connected with said head structure base portion and said blade cap portion is provided with means for securing the blade cap structure to said blade seat structure.

29. The hair trimming device as in claim 28, wherein said blade seat structure includes a blade seat and is provided with support means for supporting said blade seat, said blade seat having an edge portion located near but spaced apart from said sharpened first edge of said razor blade strip.

30. The hair trimming device as in claim 28, wherein said blade cap structure is provided with a series of spaced teeth which extend beyond the sharpened first edge of said razor blade, and said blade seat structure is provided with an edge portion which is located near but spaced apart from said sharpened first edge of said razor blade strip.

31. The hair trimming device as in claim 27, wherein said blade seat structure is provided with a series of spaced teeth which extend beyond the sharpened first edge of said razor blade strip, and said blade cap structure is provided with an edge portion which is located near but spaced apart from said sharpened first edge of said razor blade strip.

32. The hair trimming device as in claim 26, wherein said curved guard portion and said blade strip are substantially U-shaped.

* * * * *

UNITED STATES PATENT AND TRADEMARK OFFICE

CERTIFICATE OF CORRECTION

PATENT NO. : 5,568,688

DATED : October 29, 1996

INVENTOR(S) : E. Andrews

It is certified that error appears in the above-indentified patent and that said Letters Patent is hereby corrected as shown below:

Column 3, line 54, replace ";" with -- : --.

Column 5, line 40, after "with" add --a--.

Column 7, line 32, replace "blade 46" with --blade strip 44--.

Column 7, line 44, after fingers add --54--.

Column 7, line 49, after applied delete "to".

Column 8, line 50, replace after strip "58" with --56--.

Column 8, line 55, replace after portion "58" with --56--.

Column 8, line 58, replace after portion "58" with --56--.

Column 10, line 20, after "14C" add --on--.

Column 10, line 29, replace "13" with -- - --.

Column 10, line 64, replace "a" with --an--.

UNITED STATES PATENT AND TRADEMARK OFFICE

CERTIFICATE OF CORRECTION

PATENT NO. : 5,568,688

DATED : October 29, 1996

INVENTOR(S) : E. Andrews

It is certified that error appears in the above-indentified patent and that said Letters Patent is hereby corrected as shown below:

Column 14, line 12, claim 16, replace "e" with --a--.

Column 14, line 44, claim 19, replace "sid" with --said--.

Signed and Sealed this

Fifth Day of August, 1997

Bruce Lehman

*Attest:*

BRUCE LEHMAN

*Attesting Officer*

*Commissioner of Patents and Trademarks*